US005310460A

United States Patent [19]

Pelton et al.

[11] Patent Number: 5,310,460

[45] Date of Patent: May 10, 1994

[54] CLOTTING WASHING

[76] Inventors: Robert H. Pelton, 167 Old Ancaster Road, Dundas Ontario, Canada, L9H 3R3; Pei Li, 1281 Fennel Avenue E., Hamilton, Ontario, Canada, L8T 1T3

[21] Appl. No.: 30,278

[22] PCT Filed: Sep. 27, 1991

[86] PCT No.: PCT/CA91/00350

§ 371 Date: Jun. 25, 1993

§ 102(e) Date: Jun. 25, 1993

[87] PCT Pub. No.: WO92/06241

PCT Pub. Date: Apr. 16, 1992

[30] Foreign Application Priority Data

Sep. 28, 1991 [GB] United Kingdom ..... 9021126

[51] Int. Cl.[5] ..... D21C 9/02

[52] U.S. Cl. ..... 162/60; 162/72; 162/76

[58] Field of Search ..... 8/156; 162/60, 72, 76

[56] References Cited

U.S. PATENT DOCUMENTS 4,297,164 10/1981 Lee ..... 162/60

4,810,328 3/1989 Freis et al. ..... 162/60

OTHER PUBLICATIONS

Tappi Journal, Nov. 1984, pp. 100 to 103.

*Primary Examiner*—W. Gary Jones

*Assistant Examiner*—Dean T. Nguyen

*Attorney, Agent, or Firm*—Sim & McBurney

[57] ABSTRACT

Brown stock washing of wood pulp is improved by adding a water-soluble cationic polymer to the wash water. The cationic polymer reacts with lignin solution present in the larger channels in the pulp mat to give a precipitate which lowers the flow rate of wash water through the larger channels. A more efficient wash water usage is obtained.

9 Claims, 7 Drawing Sheets

CLOTTING WASHING

The present invention relates to an improvement in the displacement washing of fibrous masses to remove contaminants therefrom, particularly in pulp mill brown stock washing operations.

BACKGROUND OF THE INVENTION

In the formation of wood pulp from which paper is made, one commonly-employed procedure involves chemical treatment of wood chips to dissolve lignin and free the cellulosic fibres from the wood chips in a digestion operation, such as by the Kraft process. The resulting slurry of wood fibres in spent digestion chemicals, or black liquor, then is passed to a brown stock washing operation wherein the pulp is washed to remove the black liquor, which contains a variety of sodium salts and lignin. The washed pulp then usually is passed to a bleach plant wherein the pulp is bleached and further purified to provide the desired product.

It is desirable to remove the black liquor as efficiently as possible from the pulp in the brown stock washing operation, so as to minimize the chemical requirements of the bleach plant. At the same time, it is desirable to minimize the volume of wash water employed, so as to minimize dilution of the black liquor as it passes to the pulp mill recovery system, which typically involves an initial evaporation operation. The greater the dilution of the black liquor, the greater is the evaporative heat and hence the energy requirement of the evaporation operation.

Brown stock washing generally is carried out by a displacement washing operation wherein a screened drum (typically 15 feet in diameter and 16 feet long) rotates about a horizontal axis through the pulp slurry to pick up a mat of the slurry on its screened surface and then showers of wash water are applied to the outer surface of the mat to displace the black liquor from the pulp mat through the screen into the interior of the drum, usually with the assistance of vacuum applied internally of the drum. The brown stock washing operation generally comprises a plurality, typically three or four, of such displacement washing operations, with wash water flowing countercurrent to the pulp between the individual displacement washing operations and the pulp mat being repulped between the individual pulping operations.

The volume of wash water required to displace a unit volume of liquor entrained in the pulp determines the efficiency of the displacement washing operation. If a single unit volume of wash water is required, then the washing is 100% efficient. However, pulp mill displacement washing operations never attain such efficiency levels, for example, four times the volume of wash water is required to achieve a 75% washing efficiency.

This inefficient use of wash water arises from a phenomenon known as "Channelling", whereby channels for wash water flow are formed through the pulp mat during displacement washing, so that the wash water tends to try to flow through the channels, rather than uniformly through the pulp mat, the channels providing the lesser resistance to wash water flow. As a consequence, some of the liquor trapped inside the fibres is not displaced by wash water during the washing operation.

This phenomenon is discussed in U.S. Pat. No. 4,297,164 and in an article in Tappi Journal, November 1984, pp. 100 to 103. The solution to the channelling problem which is suggested in this prior art is to alter the rheological properties of the wash water, so that the mobility of the wash water is decreased. In particular, the prior art describes the addition of polymers that affect the permeability of the wash water with respect to the pulp mat, when the wash water begins to penetrate a region of high permeability in the pulp mat (i.e. a channel), the region becomes filled with the wash water which has a lover mobility than the solution to be displaced and, in this way, the channeling penetration in retarded and a reduction in wash water requirements is realized. U.S. Pat. No. 4,810,328 similarly discloses compositions including anionic polymers.

SUMMARY OF INVENTION

The present invention is directed, in one aspect, to an improved brown stock washing process for the removal of black liquor from wood pulp which is able to achieve minimal dilution of black liquor, by using water-soluble cationically-charged species. Rather than changing the mobility of the wash water solution using water-soluble polymers, as described in the prior art referred to above, the present invention relies on ionic interaction between the water-soluble cationically-charged species and lignin in the pulp mat to form a solid material.

While the present invention is particularly described with respect to an improved brown stock washing process, the principles of the invention described herein may be employed in any diffusion washing operation, including other pulp mill washing operations, wherein lignin or other material reacting with water-soluble cationically-charged species is removed from a porous medium.

In the present invention, channelling of the pulp mat is decreased by effecting reaction between lignin in the pulp mat and at least one water-soluble cationically-charged species in the wash water to form a solid precipitate in the channel, thereby lowering the flow rate of wash water through the channel and hence providing a more uniform washing of pulp mat by wash water. We term this procedure "clotting washing".

The process of the present invention, therefore, senses areas of the pulp mat or other fibrous mat of higher flow rate (i.e. the channels) and then positions solid clots in the channels, by the interaction of lignin (a high molecular weight anionic polymer) solution present in the channels with the water-soluble cationically-charged species in the wash water.

The formation of the clots in the channels then inhibits the flow of wash water through the channels, so that the wash water preferentially flows through the fibrous mat to displace the black liquor therefrom. In this way, a more efficient use of wash water in displacement washing is achieved. Since a more efficient usage of the wash water is achieved, a lesser dilution of pulp mill black liquor results.

Accordingly, in its broadest aspect, the present invention provides an improved process for the displacement washing of fibrous material, which comprises applying a wash water to a mat of the fibrous material to effect displacement washing of the mat, sensing zones of higher flow rate of wash water through the mat, and precipitating solid clots in the zones so as to inhibit wash water flow in the zones and achieve a greater uniformity of displacement washing.

As discussed previously, the present invention is particularly directed to brown stock washing operations, and accordingly, in one embodiment, is directed to an improvement in a process of washing wood pulp free from spent pulping chemicals by displacement washing of a mat of the wood pulp in which a plurality of channels tend to form through the mat during such displacement washing whereby wash water tends preferentially to flow through the channels rather than uniformly through the mat.

The improvement comprises adding to the pulp mat at least one water-soluble cationically-charged species to effect reaction with lignin solution present in the channels to form a solid precipitate in the channels, so that such solid precipitate tends to lower the flow rate of wash water through the channels and provide a more uniform washing of pulp mat by wash water.

GENERAL DESCRIPTION OF INVENTION

Figure 1:
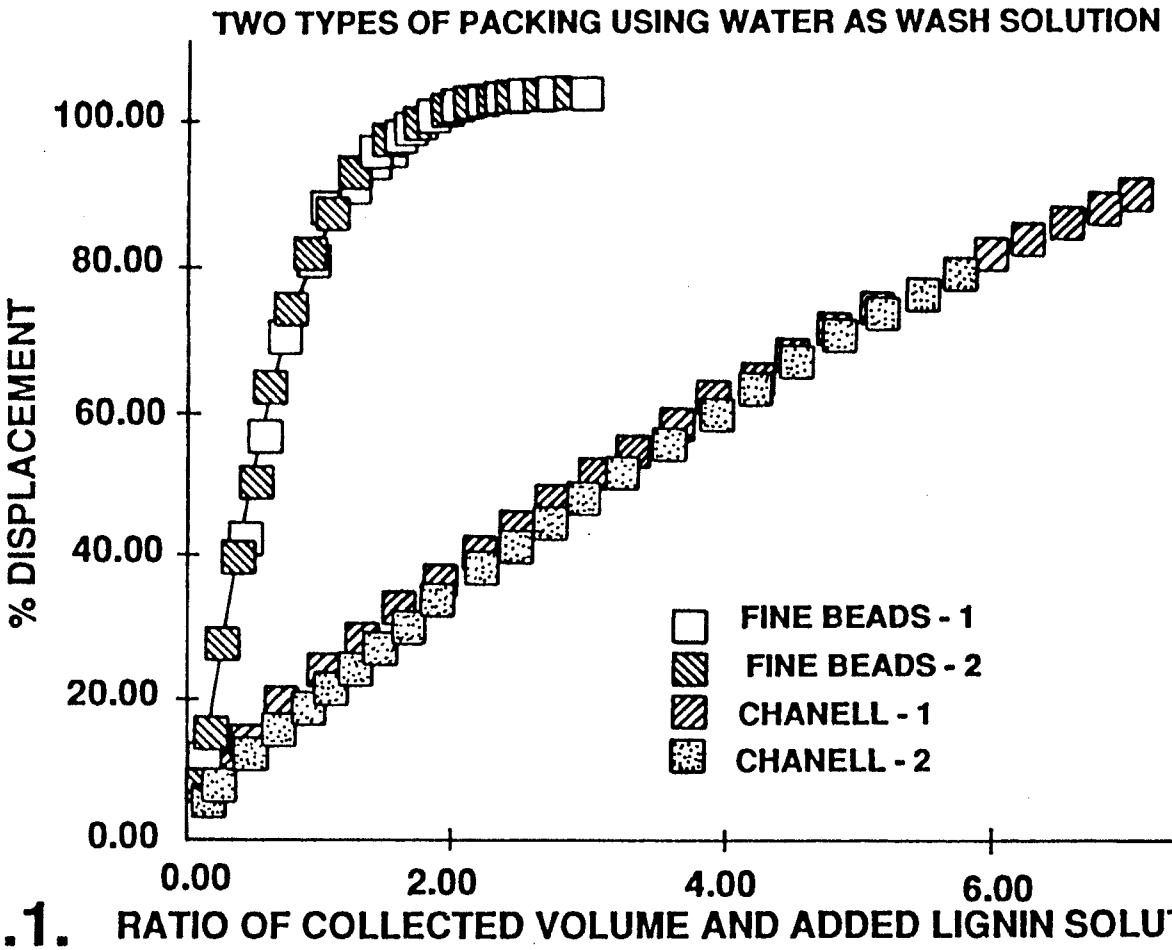
FIGS. 1 to 7 are graphical representations of data collected in the experiments described in the Examples below.

The water-soluble cationically-charged species employed herein may be selected from a variety of such materials which are capable of forming a solid product by ionic interaction with the lignin. The water-soluble cationically-charged species may comprise a cationic polymeric material, a cationic surfactant or a mixture of such species. Preferably, a cationic water-soluble polymer possesses a high charge density so as to form the solid product readily and a lower molecular weight, so as to be readily water-soluble while not significantly altering the wash water properties.

Examples of such cationic water-soluble polymers may include high molecular weight, cationic polyacrylamide with low charge density, low molecular weight, highly charged cationic polyacrylamide, cationic starches with low charge density, poly(ethyleneimines) which may be quaternized, and other cationic water-soluble polymers.

Other water-soluble polymeric components, such as water-soluble non-ionic polymers, also may be present in the wash water, if desired, along with the cationically-charged species, such as wash water containing water-soluble cationic polymer and/or cationic surfactant, and water-soluble non-ionic polymer.

The quantity of the cationically-charged species required to achieve an improvement in washing efficiency is quite small and, to some extent, is determined by the concentration of lignin in the pulp mat and the charge on the species. The quantity of material may be varied depending on the degree of formation of precipitate between species and lignin.

The water-soluble cationically-charged species may be present in the wash water fed to the showers of all the displacement washing stages in the brown stock washer. However, it is preferred to add the water-soluble cationically-charged species to the wash water in the first two stages only, so as to form the precipitate therein, and then wash out the precipitate in the later stages. The precipitate may be removed by adding additional water-soluble cationically-charged species to the pulp mat.

EXAMPLES

Example 1

An experimental apparatus was set up to provide a model for a pulp mat. The experiments were carried out using the model since it is difficult to make uniform wood fibre pads and obtain reproducible results in laboratory, bench-scale experiments.

Three different arrangements were employed, one using a column (185 cm long, 50 cm in diameter) filled with fine glass beads approximately 100 micrometers in diameter, simulating a non-channelled fibrous mat, and the other using a column having a central mass of larger sized glass beads (approximately 1200 micrometers in diameter) surrounded by the fine glass beads, the larger-sized beads simulating a channel in a fibrous mat, since they had a lesser resistance to liquid flow than the fine glass beads.

A synthetic lignin solution was prepared by dissolving 12.5 g of indulin C in 500 ml of distilled water and mixing with 100 g of sucrose. 2 g of sodium hydroxide was added and the solution stirred. The solution possessed the properties:

pH=12.03

Viscosity (25|C)=2.37 cp (2.37 mPa)

2.5% lignin concentration by weight

In addition, a lignin solution was obtained from a pulp mill and had the following properties:

pH=11.8

Viscosity (25|C)=1.20 cp (1.2 mPa)

3.2 g Na/L (for atomic adsorption)

3.7 g lignin/L (from UV spectroscopy)

(a) In a first series of experiments, the columns were tested for efficiency of displacement washing of lignin solution therefrom using water as the displacing fluid, and the results compared for the column comprising only fine glass beads and then containing the larger glass beads.

The results of these experiments in duplicate are shown graphically in FIG. 1. As may be seen therein, the presence of the central "channel" caused the volume of wash water required to displace lignin from the column to be significantly increased.

Figure 2:
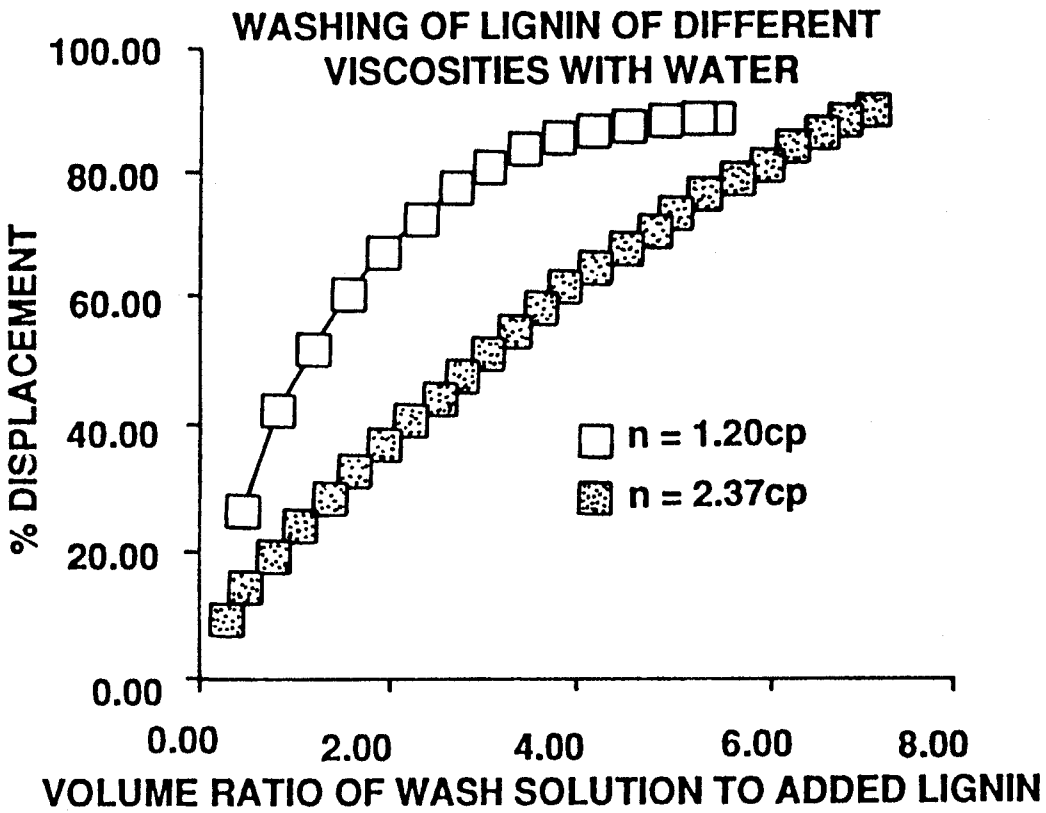

(b) In a second series of experiments, the two lignin solutions described above were processed by the channelled column and the washing efficiency determined. The results of these experiments were plotted graphically as FIG. 2. As may be seen, an increased viscosity of lignin solution resulted in a decreased washing efficiency with water.

(c) In a third series of experiments, the washing efficiencies of these solutions in removing lignin were tested on the channelled column. Comparisons were made between water, an aqueous solution of 50 ppm non-ionic polyacrylamide (as described in the prior art as referred to above), and an aqueous solution of 50 ppm of a copolymer of diallydimethylammonium chloride (DADMAC) and acrylamide bearing a 38% charge.

Figure 3:
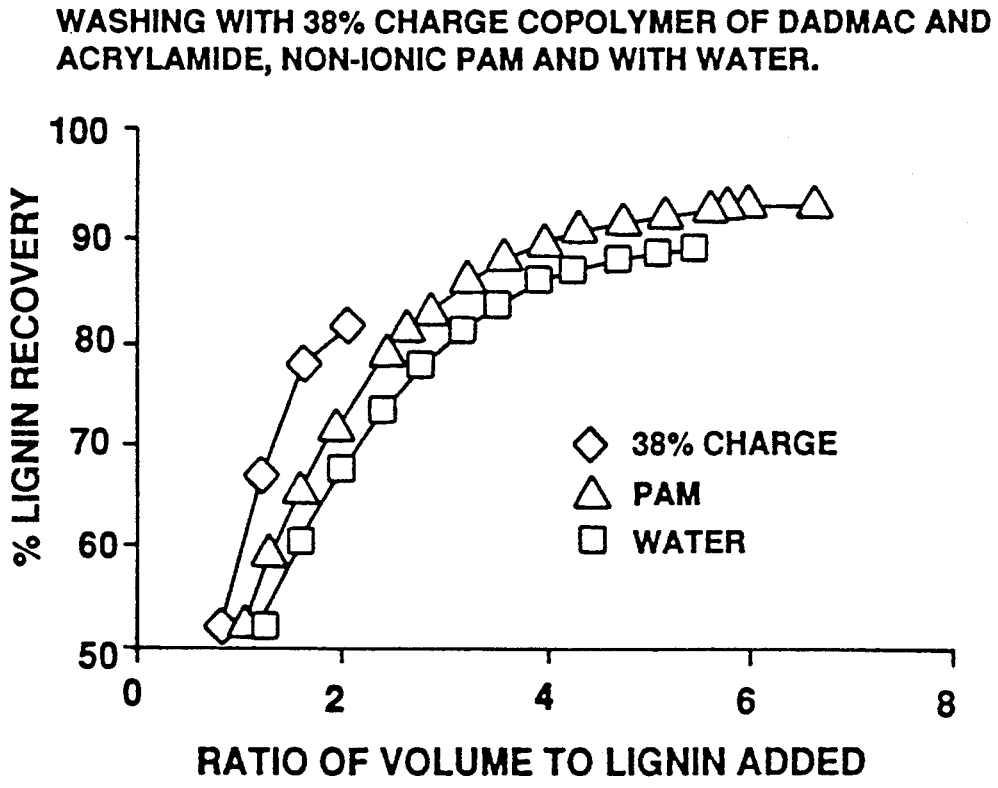

The results obtained were plotted graphically as FIG. 3. As may be seen from this FIG. 3, while the presence of the non-ionic polymer improved the washing efficiency when compared to water, the presence of the highly-charged copolymer significantly further increased the washing efficiency. This data clearly demonstrates the principle of improved washing efficiency by clotting washing.

Example 2

The experiments of Example 1 were repeated using 1000 mg/L of polyDADMAC of viscosity 1.3 mPa and the lignin recovery of pulp mill lignin solution obtained was compared to water-washing alone and to washing with a 20 wt % glycerine solution of comparable viscosity (1.5 mPa) to that of the polyDADMAC solution.

Figure 4:
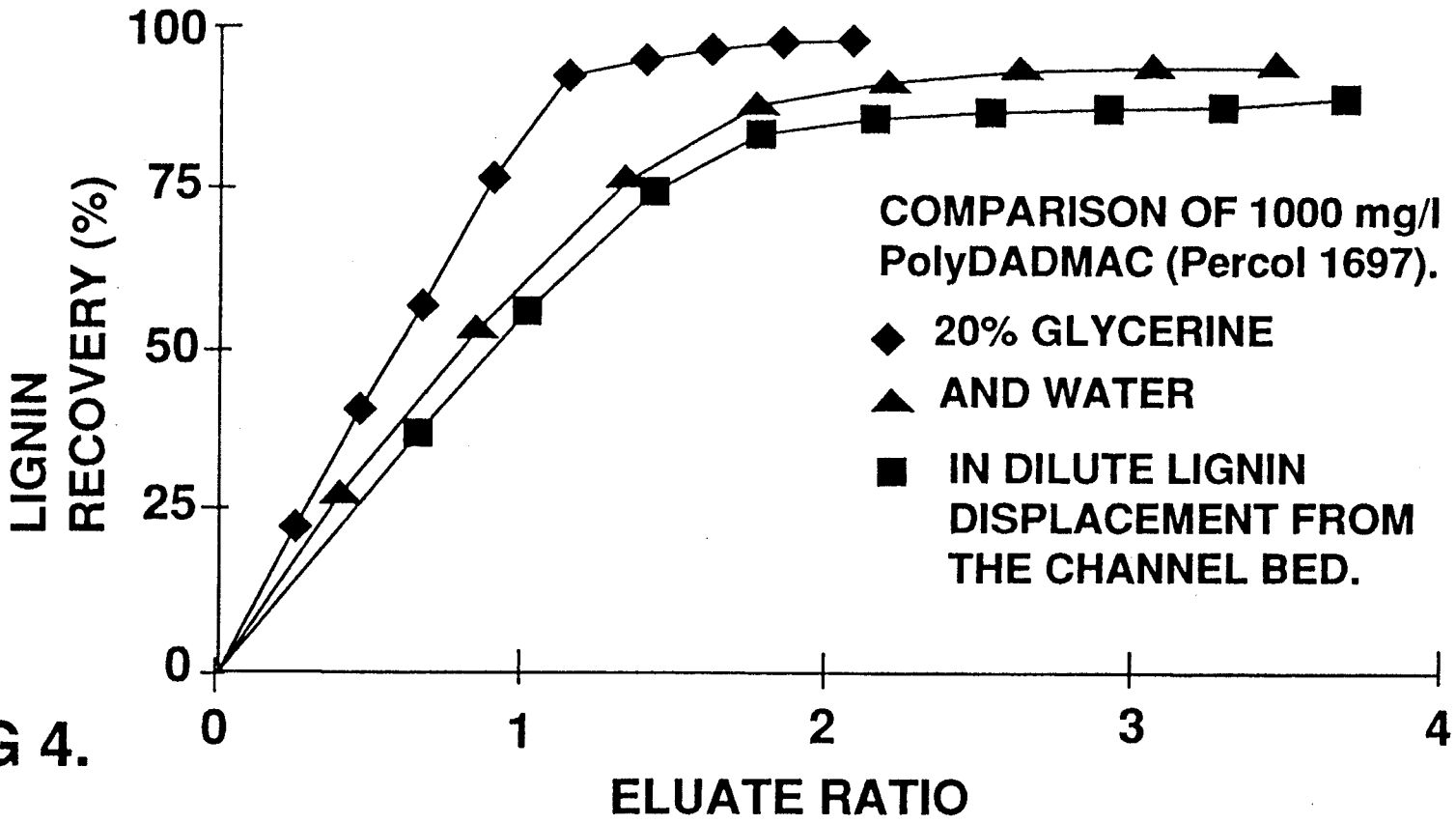

The results obtained are plotted graphically in FIG. 4. As may be seen, the presence of the cationic polymer caused a significant improvement in the efficiency of lignin displacement from the channel bed. For example, at the eluate volume ratio of 1, the percent lignin recoveries were about 50% and 80% for water and polymer solution respectively.

Although the viscosity of the glycerine solution was similar to that of the polyDADMAC solution, the glycerine solution was much less effective than the cationic polymer solution at improving displacement washing, demonstrating that displacement washing is more efficient when the cationic polymer is dissolved in the wash water.

Example 3

Figure 5:
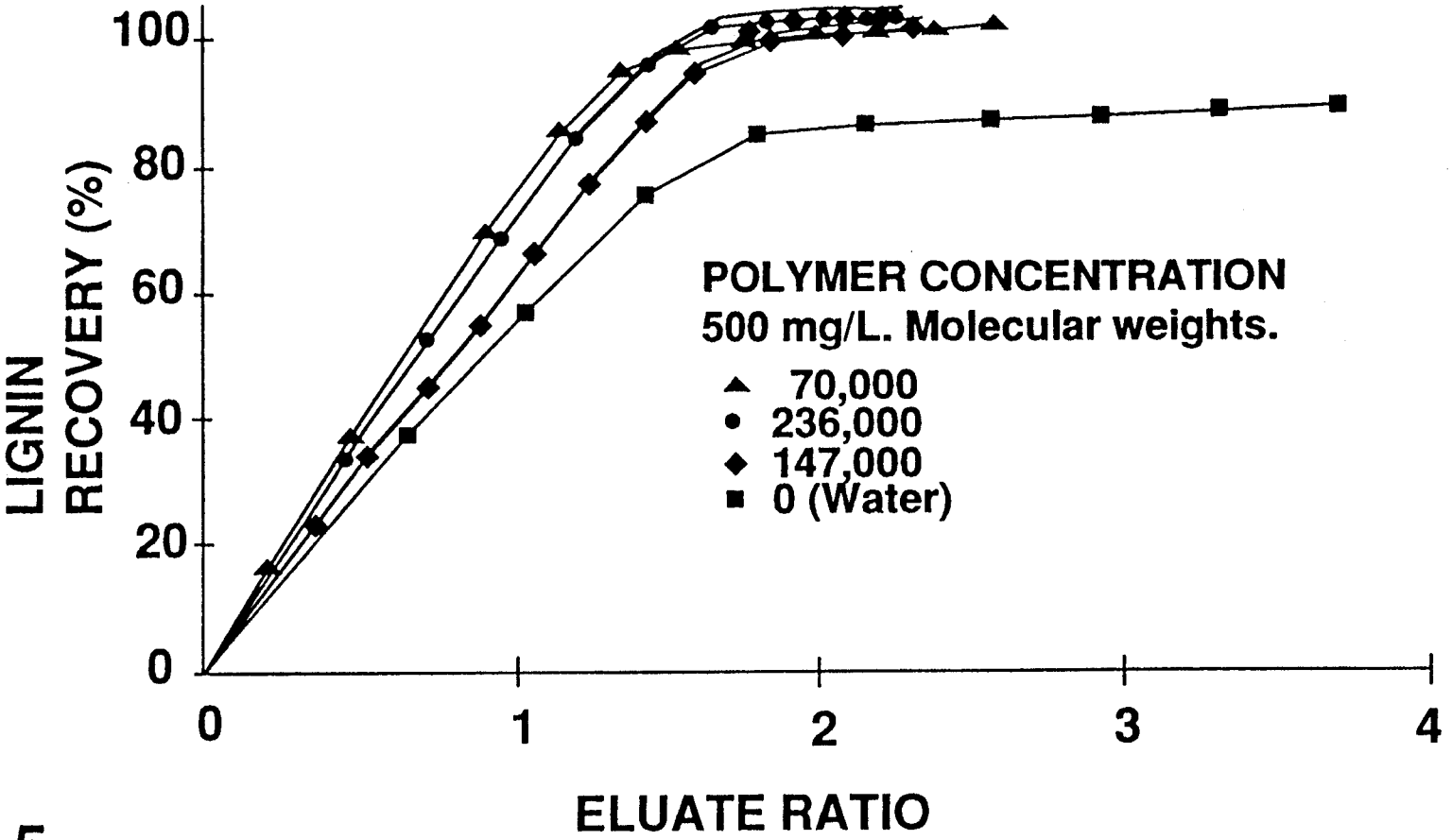

Variables of the parameters of displacement washing of pulp mill lignin were investigated in additional experiments, as follow:

(a) The influence of molecular weight of polyDADMAC on displacement washing according to the procedure of Example 1 was investigated. The results obtained are shown in FIG. 5. As may be seen, the molecular weight had little or no influence on the efficiency of displacement washing.

Figure 6:
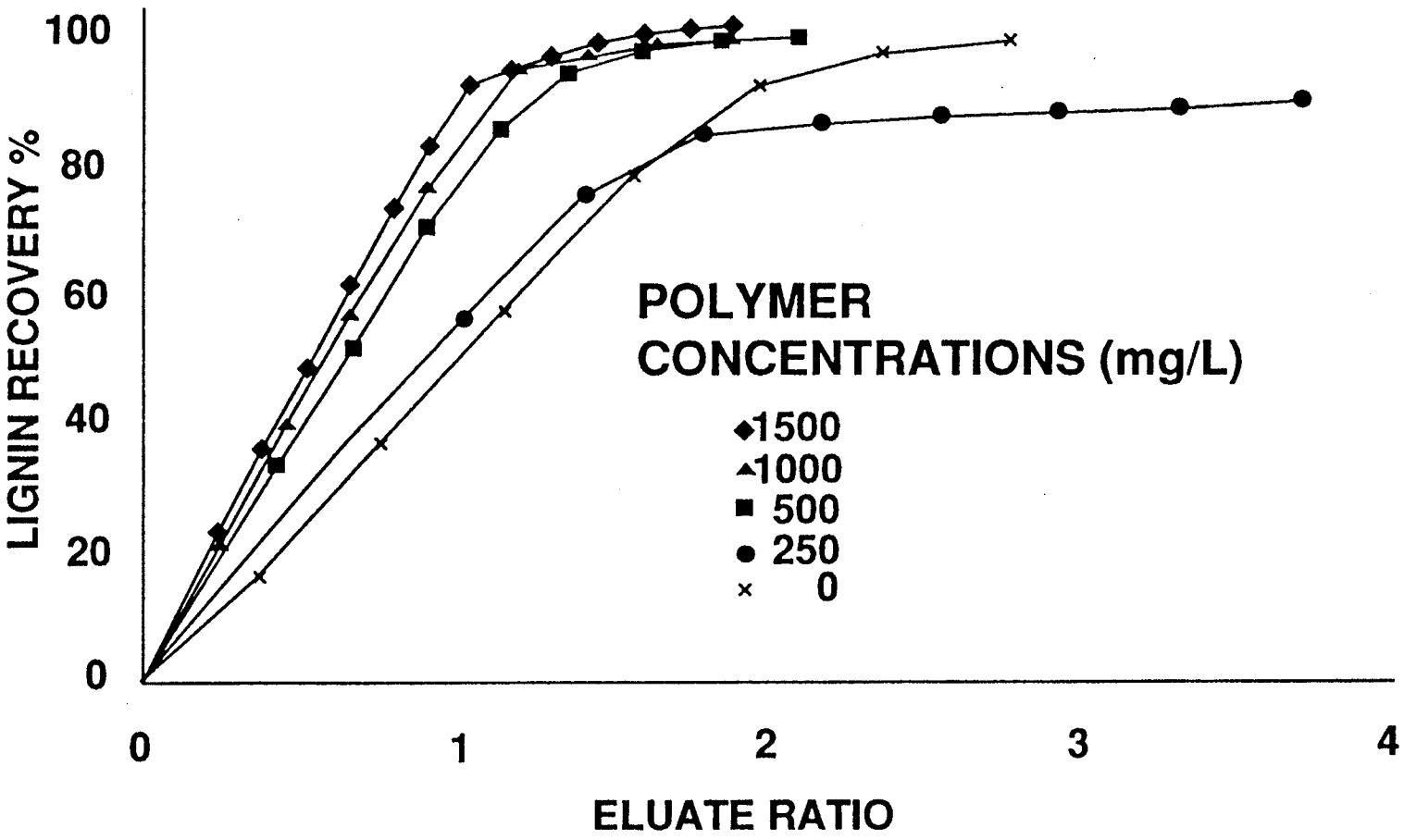

(b) The influence of polyDADMAC concentration on dilute lignin displacement from the channel bed using the procedure of Example 1 was investigated and the results obtained are shown in FIG. 6. As may be seen, 250 mg/L polyDADMAC, the lowest concentration tested, gave little improvement over water. Washing was much improved at the three higher polymer concentrations. There was a systematic improvement going from 500 to 1000 mg/L, but the improvement going from 1000 to 1500 mg/L was small, since the washing behaviour was close to ideal.

Example 4

Experiments were carried out using the synthetic lignin solution described in Example 1.

Figure 7:
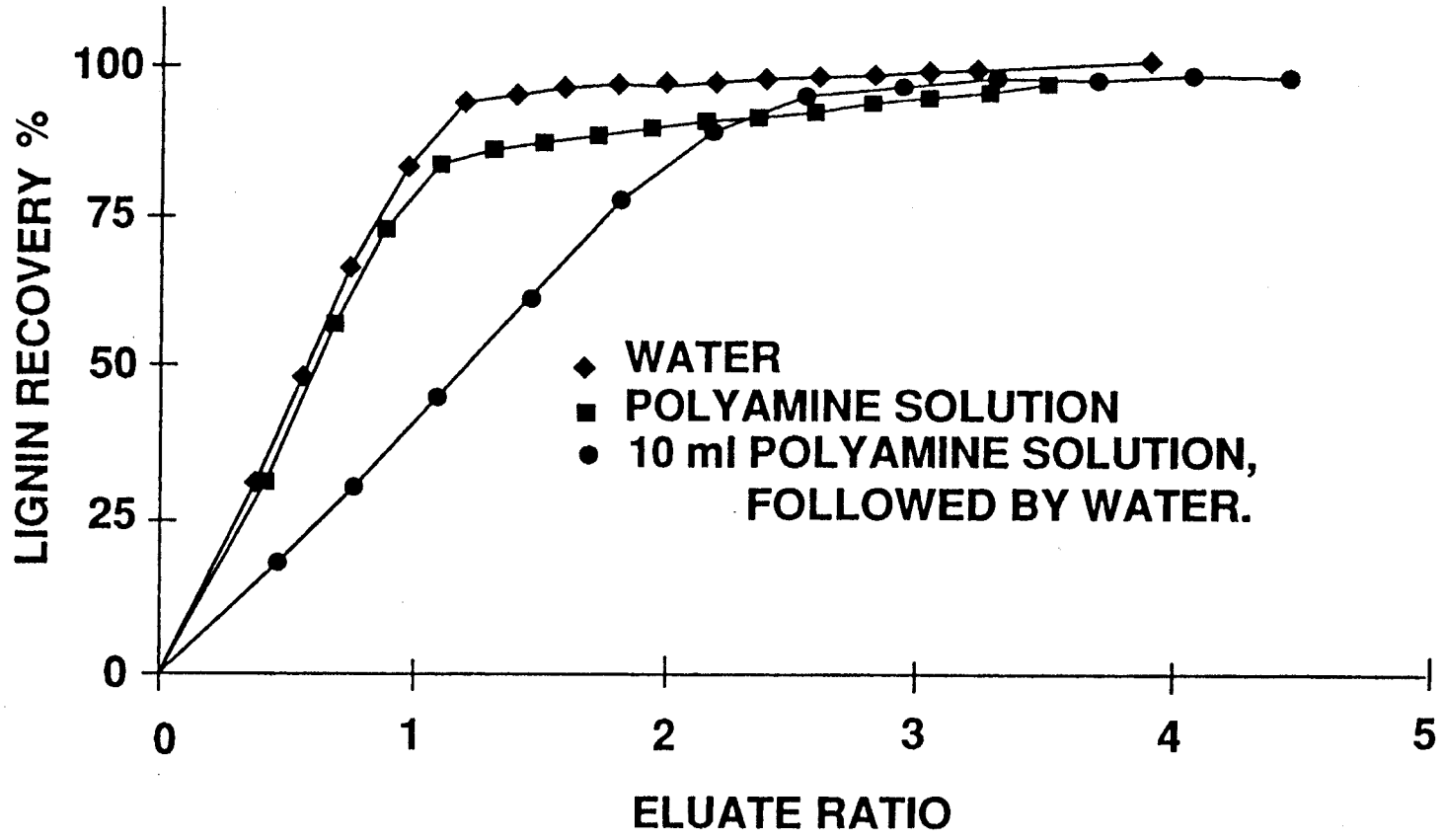

FIG. 7 compares the strategy of adding 10 mL of cationic polymer solution to the bed followed by water washing, so as to decrease the amount of cationic polymer consumed in washing, with the strategy of washing using cationic polymer solution only. As may be seen the two strategies are almost equivalent.

Comparison of this washing data with that obtained using the pulp mill lignin solution (Example 2, FIG. 4) shows little difference in displacement behavior of the two types of lignin solution with water even though the viscosity of the synthetic black liquor solution is 2.5 times greater than the viscosity of the displacing wash water.

Example 5

The experiments described in Examples 1 to 4 were repeated using a water-soluble cationic amine (Percol 1597) in place of polyDADMAC. An equivalent improvement in displacement washing to polyDADMAC was exhibited using the polyamine.

SUMMARY OF DISCLOSURE

In summary of this disclosure, the present invention provides a novel displacement washing process wherein the efficiency of use of wash water for the removal of contaminants from fibrous material is improved by effecting the precipitation of clots in channels in the fibrous material. Modifications are possible within the scope of this invention.

We claim:

1. An improved process for the displacement washing of fibrous material, which comprises:

applying a wash water to a mat of said fibrous material to effect displacement washing of said mat, sensing zones of higher flow rate of wash water through said mat, and precipitating solid clots formed by ionic interaction between oppositely-charged species in said mat and in said wash water in said zones so as to inhibit wash water flow in said zones and to achieve a greater uniformity of displacement washing.

2. The process of claim 1 wherein said species in said mat is anionic and the species in said wash water is cationic.

3. A process of washing wood pulp free from spent pulping chemicals by displacement washing of a mat of said wood pulp, the improvement which comprises:

applying a wash water to a mat of said wood pulp to effect displacement washing of said mat, sensing zones of higher flow rate of wash water through said mat, and adding to said pulp mat at least one water-soluble cationically-charged species to effect reaction with lignin solution present in a plurality of channels tending to form through the mat during said displacement washing to form a solid precipitate in said channels, so that such solid precipitate tends to lower the flow rate of wash water through said channels and provide a more uniform washing of the pulp mat by wash water.

4. The process of claim 3 wherein said water-soluble cationically-charged species is at least one water-soluble cationic polymer and/or at least one water-soluble cationic surfactant.

5. The process of claim 4 wherein said water-soluble cationic polymer possesses a high charge density.

6. The process of claim 3 wherein said water-soluble cationic polymer is a polyacrylamide or a polyamine.

7. The process of claim 3 including subsequently removing said solid precipitate from said mat.

8. The process of claim 3 wherein said displacement washing is effected in a multiple stage brown stock washing operation and said water-soluble cationically-charged species is added to the pulp mat by being dissolved in said wash water applied to at least some of the stages of said multiple stage washing operation.

9. The process of claim 8 wherein there are at least two stages in said washing operation and said water-soluble cationically-charged species is applied in the first and second stages only.

* * * * *